United States Patent [19]

LaBate

[11] Patent Number: 4,725,047

[45] Date of Patent: Feb. 16, 1988

[54] DEVICE FOR INTRODUCING GAS INTO MOLTEN METAL

[76] Inventor: Micheal D. LaBate, 115 Hazen Ave., Ellwood City, Pa. 16117

[21] Appl. No.: 913,999

[22] Filed: Oct. 1, 1986

Related U.S. Application Data

[63] Continuation-in-part of Ser. No. 769,413, Aug. 26, 1985, Pat. No. 4,632,367, which is a continuation-in-part of Ser. No. 662,831, Oct. 19, 1984, Pat. No. 4,538,795.

[51] Int. Cl.[4] ..... C21C 5/48

[52] U.S. Cl. ..... 266/270; 266/218

[58] Field of Search ..... 266/218, 220, 265, 270, 266/280, 283

[56] References Cited

U.S. PATENT DOCUMENTS

| | | | |
|---|---|---|---|
| 2,811,346 | 10/1957 | Spire | 266/220 |
| 3,330,645 | 7/1967 | De Moustier et al. | 266/220 |
| 3,610,602 | 10/1971 | Deacon | 266/220 |
| 3,834,685 | 9/1974 | Ziemkiewicz et al. | 266/220 |
| 4,053,147 | 10/1977 | Moser et al. | 266/220 |

FOREIGN PATENT DOCUMENTS

| | | | |
|---|---|---|---|
| 648343 | 2/1979 | U.S.S.R. | 266/220 |

*Primary Examiner*—L. Dewayne Rutledge
*Assistant Examiner*—Robert L. McDowell
*Attorney, Agent, or Firm*—Harpman & Harpman

[57] ABSTRACT

A device for introducing gas into a mass of molten metal in a container, by way of an opening in the container and a pocket block having a passageway extending vertically therethrough, the pocket block forming a portion of a refractory lining in said container, a refractory plug and an open ended shell thereabout in spaced relation positioned in said passageway in said pocket block to form a gas passageway with said shell and refractory plug extending outwardly of and above said pocket block in protecting relation to said refractory plug with respect to molten metal introduced into said container and so as to form a hot metal dam protecting said gas passageway around said refractory plug. A ceramic plate larger than the refractory plug and pocket block is attached to the plug and pocket block to stop molten metal leaks.

9 Claims, 8 Drawing Figures

DEVICE FOR INTRODUCING GAS INTO MOLTEN METAL

This is a continuation-in-part of Ser. No. 06/769,413, filed 8/26/85, now Pat. No. 4,632,361 which was a continuation-in-part of Ser. No. 06/662,831, filed 10/19/84, now U.S. Pat. No. 4,538,795.

BACKGROUND OF THE INVENTION

1. Technical Field

This invention relates to devices for insufflating gas into a mass of molten metal without metal leakage.

2. Description of the Prior Art

Prior structures of this type have generally employed permeable plugs through which the gas is introduced into the molten metal. Such typical devices may be seen in U.S. Pat. Nos. 2,811,346 of Oct. 1957 to E. Spire, 3,330,645 of July, 1967 to E. DeMoustier, et al., 3,610,602 of Oct. 1971 to A. J. Deacon, 3,834,685 of Sept. 1973 to L. P. Ziemkiewicz, et al., and 4,053,147 of Jan. 1976 to R. Moser, et al.

In all of these prior art devices, the gas must flow upwardly through a gas permeable body which in U.S. Pat. No. 2,811,346 is a porous refractory material. The same porous material is disclosed in U.S. Pat. No. 3,330,645 and this patent additionally proposes to form tubular passageways through the porous material. The body of the device in U.S. Pat. No. 3,610,602 is formed of permeable refractory as is the body of the device shown in U.S. Pat. No. 3,834,685 and the same is true of the body of the device shown in U.S. Pat. No. 4,053,147.

French Pat. No. 2,451,945 has a porous stopper plug as has U.S. Pat. No. 3,208,117.

The present invention comprises an improvement with respect to my U.S. Pats. Nos. 4,396,179 and 4,483,520 wherein a non-permeable refractory plug is disclosed having a spaced stainless steel jacket thereabout forming an annular passageway through which the gas is introduced into the molten metal. A displaceable cap is provided in these devices for initially protecting the upper end of the device and the annular gas passageway from being plugged by molten metal introduced into the ladle in which the device is positioned.

In actual practice, it has been determined that the cap is frequently displaced by the molten metal and the molten metal tends to plug the annular gas passageway unless a substantially higher gas pressure is employed to move the molten metal away from the annular gas emitting opening.

Furthermore, the molten metal first introduced into a ladle equipped with the device tends to freeze almost instantaneously and frequently before the gas is introduced or during the initial introduction of the gas and thus closes the annular gas passageway and renders the device ineffective.

The present invention adds a hot metal dam above the annular gas emitting passageway of the device and protects the passageway and the upper portion of the device from the molten metal whether the gas is flowing or not and when the gas flows, it improves the stirring action substantially by forming a large and distinct and jet-like stream of the gas bubbles which result in increased turbulence and stirring action in the molten metal. The present invention also adds a ceramic safety plate to the device and pocket block to stop molten metal from leaking around the same.

SUMMARY OF THE INVENTION

A device for introducing gas into molten metal upon the filling of a ladle or the like with such molten metal uses a pocket block of refractory which is incorporated in the bricked or rammed lining of the ladle, the block having a vertically extending passageway therethrough and a plug positioned therein comprising a non-permeable refractory plug with a spaced stainless steel and/or ceramic shell thereabout to define a gas passageway through the block. A combined shield and hot metal dam in the form of an upwardly extending circular extension of the stainless steel and/or ceramic shell is positioned above the opening defined thereby and protects the non-permeable refractory plug whereby gas for agitating, stirring, rolling and/or effecting the desired chemistry of the molten metal can be introduced into the molten metal in suitable streams substantially increasing the agitating, stirring, and rolling action obtained.

DESCRIPTION OF THE PREFERRED EMBODIMENT

Figure 1:
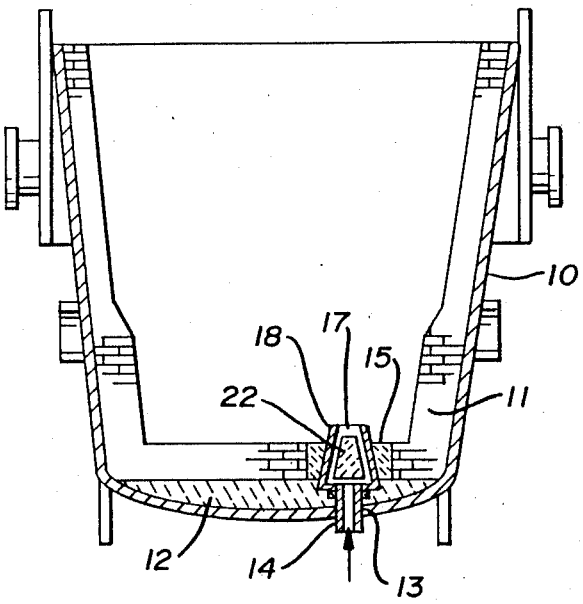
FIG. 1 is a cross sectional side elevation of a ladle showing the device for introducing gas into molten metal installed therein.
Figure 2:
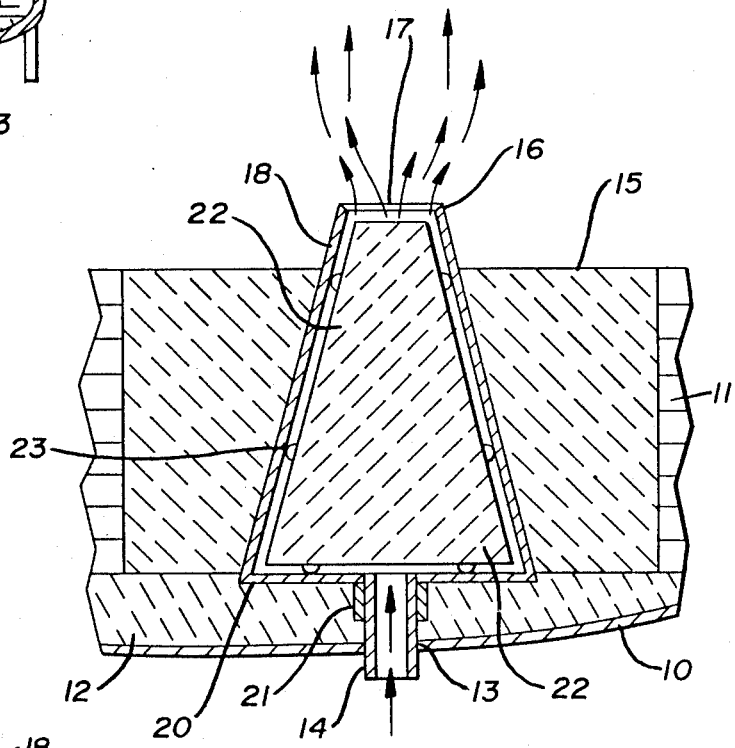
FIG. 2 is an enlarged cross sectional detail of the device for introducing gas into molten metal and illustrating the hot metal dam with arrows indicating the stream of gas occasioned by its presence.
Figure 3:
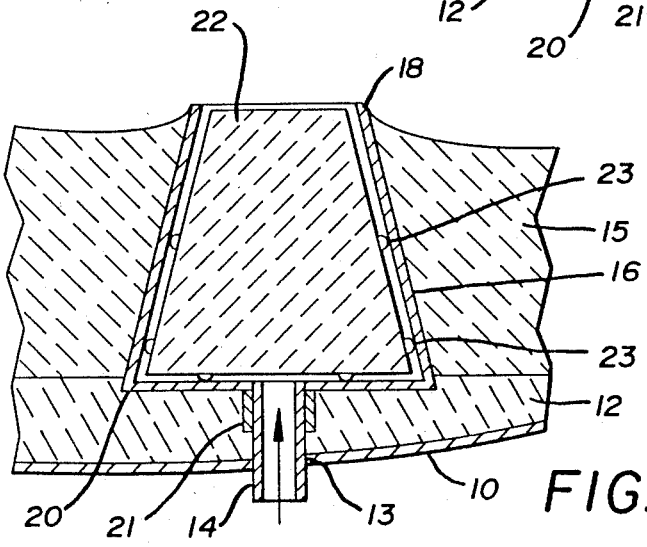
FIG. 3 is an enlarged cross sectional detail with parts broken away and parts in cross section of the device of the invention in an eroded pocket block.

In the form of the invention chosen for illustration herein, the device for introducing gas into molten metal in an improved manner may be seen in FIGS. 1, 2 and 3 of the drawings in a ladle 10 having a refractory brick lining 11 incorporating a rammed refractory base 12. An opening 13 in the bottom of the ladle 10 is provided with a tube 14 through which gas is introduced. A pocket block 15 is provided with a conical passageway centrally thereof which is arranged in registry with the inner upper end of the tube 14. A frusto-conical shell 16, preferably made of stainless steel or a fired ceramic or a ceramic coated metal as best seen in FIG. 2 of the drawings, has an open upper end 17 extending substantially above the pocket block 15 so as to form a protective hot metal dam 18 with respect to the open end 17 of the frusto-conical shell 16.

By referring to FIG. 2 of the drawings, it will be seen that the bottom of the frusto-conical shell 16 comprises a circular disc 20 having an annular depending flange 21 centrally thereof about an opening therethrough, the flange 21 being adapted for registry over the tube 14 through which the gas is introduced into the ladle as illustrated by the arrows.

The majority of the interior of the frusto-conical shell 16 is filled by a non-permeable ceramic plug 22 which is substantially the same height as the shell 16 and the configuration 23 on the exterior of the plug 22 or alternately on the interior of the shell 16 provide for the spacing of the shell 16 with respect to the plug 22 so that a gas passageway annular in cross section is formed through the pocket block 15 and thus provides that the gas introduced into the tube 14 will flow around the exterior of the plug 22 and outwardly through the opening 17 and be effectively directed by the hot metal dam 18 as shown by the arrows in FIG. 2 of the drawings. The vertical dimension of a typical pocket block (15) is at least 12 inches and the shell 16 and plug 22 are of substantially greater height than said pocket block.

By referring now to FIG. 2 of the drawings in particular, it will be observed that the arrows indicating the gas flow paths as occasioned by the hot metal dam forming the upper end of the frusto-conical shell 16 has the highly desired effect of substantially increasing the agitating, stirring and rolling action of the molten metal through which the gas streams move.

In FIG. 1 of the drawings, the device is shown in operable arrangement in the ladle 10 and it will be observed that it is of a size and so located in the ladle that the stream of gas emerging from the device by reason of the hot metal dam 18 will occupy a substantially higher overall area in the ladle 10 than has heretofore been possible with the prior art devices.

In operation, the device is installed in the conical passageway in the pocket block 15 immediately prior to the installation of the pocket block 15 in the lining of the ladle 10. Such installation is facilitated by the presence of the hot metal dam 18 as the same forms a convenient handle in holding and adjusting the device in the conical passageway of the pocket block 15 and insuring the positioning of the device and more particularly the frusto-conical shell 16 thereof in engaging relation in the conical passageway as the pocket block 15 is positioned in the lining of the ladle for registry with the opening in the refractory base 12 through which the tube 14 extends.

In FIG. 3 of the drawings, the upper end of the shell 16 and the plug 22 are illustrated as extending upwardly above the eroded sides of the pocket block 15 so that the shell 16 continues to protect the plug 22 and the adjacent portions of the pocket block 15 from rapid erosion.

The arrangement is such that the hot metal dam 18 is protected by the cooling effect of the gas being introduced through the device and directed thereagainst by the formation of the end 17 with the result that the metal initially poured into the ladle 10 and striking the hot metal dam 18 does not adversely effect the shell 16 which remains in position through the initial pouring stages and thereafter when the molten metal has covered the same, all due to the effective cooling, stirring, agitating and rolling action of the molten metal as occasioned by the jet stream of the gas being introduced thereinto.

It will occur to those skilled in the art that the device disclosed herein protects the frusto-conical shell thereof as well as preventing the plugging of the annular gas passageway defined between the shell 16 and the plug 22 as would otherwise occur upon the introduction of molten metal into the ladle. The solid ceramic plug 22 cannot be filled with metal as occurs in the prior art devices wherein the plugs are formed of porous refractory material and the device thereby insures the desirable immediate introduction of gas into the molten metal which has heretofore been seriously delayed by the blocking of the prior art devices with the molten metal and the unprotected difusing plugs and the like.

The vertical dimension of the pocket block 15 adjacent the conical passageway is substantially smaller than the height of the solid ceramic plug 22, and the height of the shell 16 with the hot metal dam 18 is greater than the height of the pocket block 15 so as to form the hot metal dam around the annular gas passageway.

Many of the prior art devices including the invention disclosed herein in FIGS. 1 through 3 have had the common fault of leaking molten metal around the plug 22, the shell 16 and around the pocket block 15. In modifications illustrated in FIGS. 4 through 8 herein, ceramic safety plates are incorporated in the devices and in the pocket blocks in which they are located to prevent such molten metal leakage.

Figure 4:
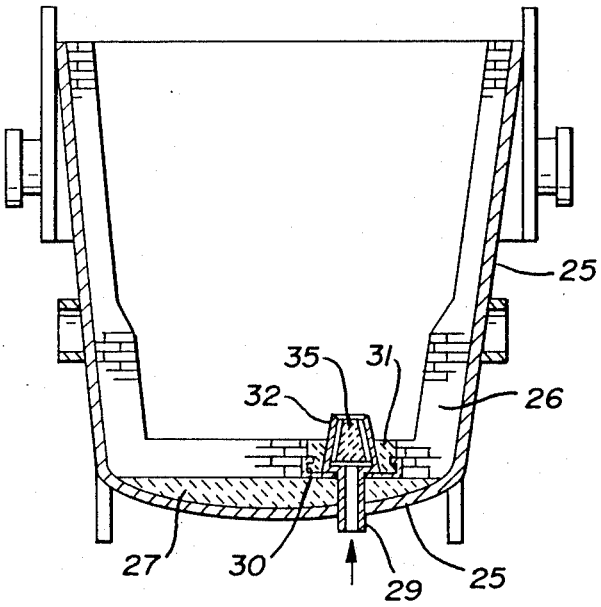
FIG. 4 is a cross sectional side elevation of a ladle showing the device for introducing gas into molten metal with a safety plate adjacent thereto.
Figure 5:
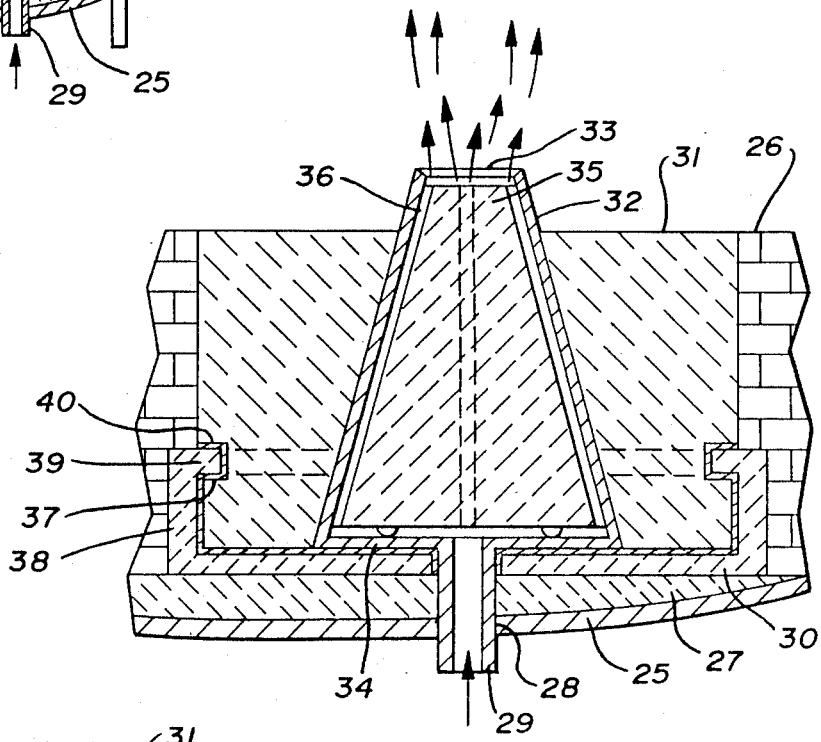
FIG. 5 is an enlarged cross sectional detail of the device for introducing gas into molten metal with a safety plate underlying the device and the pocket block in which it is positioned.
Figure 6:
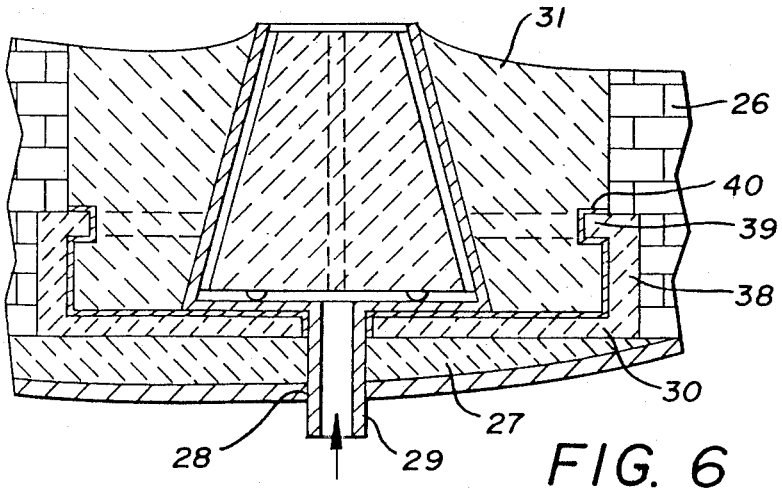
FIG. 6 is an enlarged cross sectional detail of the device of the invention in an eroded pocket block.

By referring to FIGS. 4, 5, and 6 it will be seen that a hot metal ladle 25 has a refractory brick lining 26 and a rammed refractory lining 27 in the bottom thereof. An opening 28 in the bottom of the ladle 25 has a tube 29 therein which extends vertically through the refractory lining 27 and through a ceramic plate 30 which underlies and is attached to a pocket block 31. The pocket block 31 has a conical passageway centrally thereof which is arranged in registry with the inner upper end of the tube 29. A frusto-conical shell 32 preferably made of stainless steel or a ceramic coated metal has an open upper end 33 and a bottom 34 with a central opening communicating with the upper end of the tube 29 through which gas is introduced into the ladle as illustrated by the arrows in FIGS. 4, 5, and 6. The majority of the interior of the frusto-conical shell 32 is filled by a non-premeable ceramic plug 35. The bottom of the ceramic plug 35 is spaced above the bottom 34 of the shell 32 and a plurality of circumferentially spaced longitudinally extending grooves 36 are formed in the outer surface of the ceramic plug 35 so that gas introduced through the tube 29 can and will flow upwardly therethrough and out of the open upper end 33 as indicated by the arrows in FIG. 5. The pocket block 31 is formed of refractory material and it has horizontally disposed grooves 37 in its sides. The ceramic plate 30 has an upstanding flange 38 on its periphery forming lowside walls which in turn has an inturned flange 39 on its upper edge positioned and sized for engagement in the horizontal grooves 37 in the pocket block 31. A high temperature ceramic cement 40 seals the ceramic plate 30 and its flanges 38 and 39 to the pocket block 31 and to the lower surface of the bottom 34 of the shell 32 so that hot metal in the ladle cannot move downwardly through the areas where the pocket block 31 joins the refractory lining 26 or the junction between the shell 32, the bottom portion 34 thereof and the refractory lining 27. In FIG. 6 of the drawings the combined gas introducing device, the pocket block, the safety plate formed by the ceramic plate 30 are illustrated after use in the ladle with the eroded refractory lining as described in connection with FIG. 3 of the drawings and it will be observed that the seals between the ceramic plate 30, the pocket block 31, the refractory linings 26 and 27 remain intact.

Figure 7:
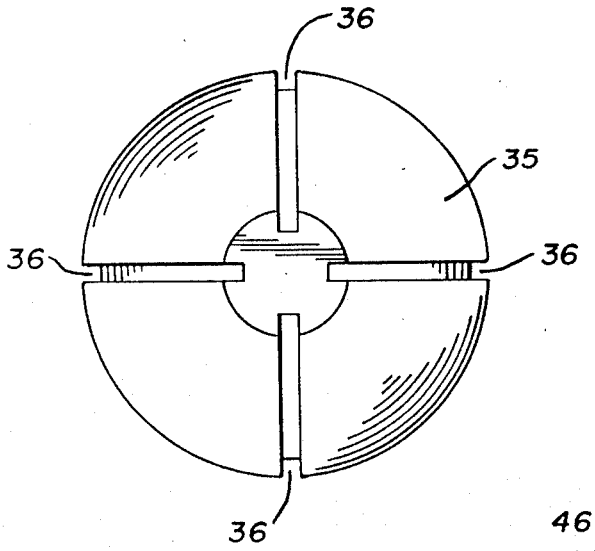
FIG. 7 is a top plan view of the refractory plug of the invention.

In FIG. 7 of the drawings an enlarged top plan view of the non-permeable ceramic plug 35 is illustrated in enlarged detail to display the circumferential spacing of the longitudinally extending angularly positioned grooves 36 in the exterior surface thereof and it will occur to those skilled in the art that alternately longitudinally extending ribs spaced circumferencially of the ceramic plug may be employed to provide suitable gas passageways necessary for introducing the gas into the molten metal.

Figure 8:
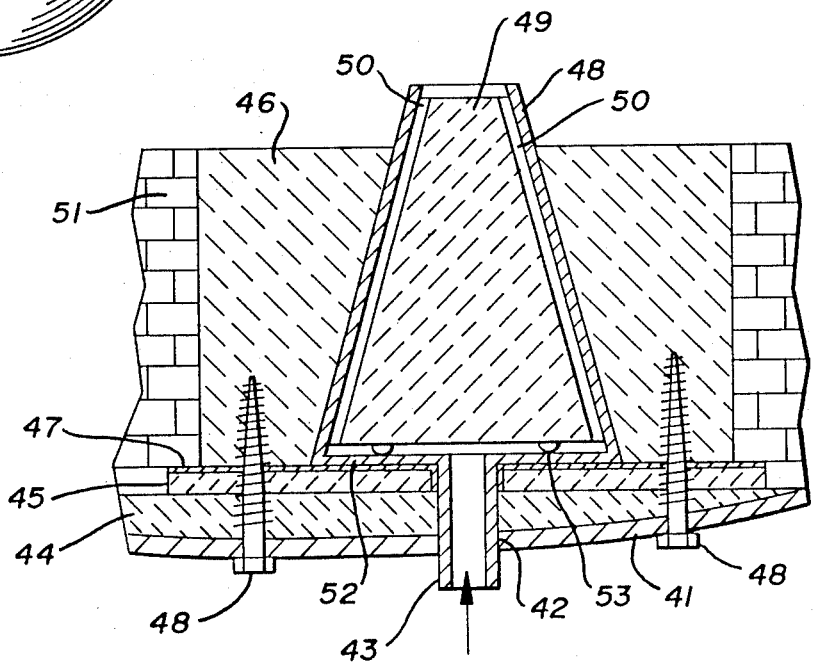
FIG. 8 is an enlarged cross sectional detail of the device of the invention showing a modification of the safety plate.

Modifications in the contruction of the safety plate formed by the ceramic plate 30 will occur to those skilled in the art and by referring to FIG. 8 of the drawings, one such modification can be seen. In FIG. 8 the bottom portion of a ladle 41 is provided with an opening 42 through which a gas delivering tube 43 is positioned. The rammed bottom refractory lining 44 of the ladle 41 sealingly engages the tube 43 which extends upwardly therethrough and through a central opening in a ceramic plate 45 which plate is larger than a pocket block 46 thereabove. The pocket block 46 having a vertical passageway therethrough which communicates with the upper end of the pipe 43, is sealed with respect to the ceramic plate 45 by a suitable ceramic cement 47 and a plurality of bolts or screws 48 are positioned upwardly through openings in the bottom of the ladle 41 through the ceramic lining 44, the ceramic plate 45 and engaged in the pocket block 46. The gas introducing device includes a frustro-conical shell 48 and a non-permeable refractory plug 49 and they are spaced with respect to one another by a plurality of longitudinally extending circumferencially spaced ribs 50. The pocket block 46 is positioned in the refractory brick lining 51 in the ladle and the peripheral edges of the ceramic plate 45 extend into the refractory brick lining 51. The frusto-conical shell 48 which is usually stainless steel has a bottom end 52 which is sealingly engaged on the upper end of the tube 43. A plurality of spacing members 43 space the lower surface of the non-permeable plug 49 with respect to the bottom end 52 so that the gas being introduced into the ladle through the device can flow easily into the device and upwardly between the ribs 50 and into the hot metal for the desirable stirring action.

Still referring to the form of the invention illustrated in FIG. 8 of the drawings, it will occur to those skilled in the art that the bolts or screws 48 which extend through openings in the bottom of the ladle 41 and upwardly through the ceramic plate 45 and into the pocket block 46 positively position the pocket block 46 in the refractory brick lining 51 and the rammed refractory lining 44 and prevent movement of the same relative thereto which would permit hot metal to flow downwardly around the pocket block. The anchoring of the pocket block 46 also insures the positive retention of the shell 48 and the non-permeable refractory plug 49 because the frusto-conical shape of the passageway in the pocket block 46 exactly matches the exterior surface of the shell 48 and its interior surface is engaged by the ribs 50 of the nonpermeable refractory plug 49, thus the entire gas introducing device is positively positioned in the ladle and incapable of movement with respect to the refractory linings thereof and such positioning along with the ceramic plate 45 and its sealing relation to the several parts of the device insure against the accidental leakage of molten metal through the device or around the same as has frequently occured in the prior art devices.

Although but two embodiments of the present invention have been illustrated and described it will be apparent to those skilled in the art that various changes and modifications may be made therein without departing from the spirit of the invention.

Having thus described my invention what I claim is:

1. An improvement in a device for introducing gas into a mass of molten metal in a container having a refractory lining and an apertured pocket block having upper, lower and side surfaces positioned in said lining in registry with an opening in said container and having a non-permeable refractory plug and a shell at least partially in spaced relation thereto defining at least one opening around the refractory plug and positioned in the aperture in said pocket block in communication with said opening; the improvement comprising an apertured ceramic plate positioned in said lining beneath said pocket block, plug and shell, a short upstanding upstanding flange on the peripheral edge of said apertured ceramic plate, said plate positioned between said lower surfaces of said pocket block and said refractory lining and sealed in relation thereto whereby molten metal in said container is prevented from entering said aperture in said pocket block in registry with said opening in said container.

2. The improvement in a device for introducing gas into a mass of molten metal set forth in claim 1 and wherein said plate comprises a flat body member of a shape matching the shape of the pocket block.

3. The improvement in a device for introducing gas into a mass of molten metal set forth in claim 1 and wherein said pocket block has a width greater than its height and wherein said plate is wider than said pocket block.

4. The improvement in a device for introducing gas into a mass of molten metal set forth in claim 1 and wherein said plate is formed of refractory material.

5. The improvement in a device for introducing gas into a mass of molten metal set forth in claim 1 and wherein an inturned flange is formed on the top of said short upstanding flange of said plate said inturned flanges engaged in grooves in said pocket block.

6. The improvement in a device for introducing gas into a mass of molten metal set forth in claim 1 and wherein ceramic cement is positioned between said plate and said pocket block for securing the same to one another.

7. The improvement in a device for introducing gas into a mass of molten metal in a container set forth in claim 1 and wherein fasteners are positioned through said container, said refractory lining and said plate and engaged in said pocket block for securing said pocket block and plate in position in said container.

8. The improvement in a device for introducing gas into a mass of molten metal in a container set forth in claim 1 and wherein a plurality of circumferentially spaced longitudinally extending grooves are formed in the outer surface of said ceramic plug.

9. The improvement in a device for introducing gas into a mass of molten metal set forth in claim 1 and wherein a plurality of circumferentially spaced longitudinally extending ribs are formed on the outer surface of the ceramic plug.

* * * * *